US011589634B2

(12) United States Patent
Von Heifner et al.

(10) Patent No.: US 11,589,634 B2
(45) **Date of Patent: *Feb. 28, 2023**

(54) COLLAPSIBLE HELMET

(71) Applicant: FEND Corp., New York, NY (US)

(72) Inventors: Christian Von Heifner, New York, NY (US); Sujene Park Kong, New York, NY (US); Jochen Rainer Schaepers, New York, NY (US)

(73) Assignee: FEND Corp., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/541,514

(22) Filed: Dec. 3, 2021

(65) Prior Publication Data

US 2022/0192309 A1 Jun. 23, 2022

Related U.S. Application Data

(63) Continuation of application No. 16/607,242, filed as application No. PCT/US2018/028945 on Apr. 23, 2018, now Pat. No. 11,191,316.

(60) Provisional application No. 62/540,245, filed on Aug. 2, 2017, provisional application No. 62/490,143, filed on Apr. 26, 2017.

(51) Int. Cl.
*A42B 3/32* (2006.01)
*A42B 3/08* (2006.01)

(52) U.S. Cl.
CPC ..... *A42B 3/322* (2013.01); *A42B 3/08* (2013.01)

(58) Field of Classification Search
CPC ..... A42B 3/222; A42B 3/08
See application file for complete search history.

(56) References Cited

U.S. PATENT DOCUMENTS

| | | | |
|---|---|---|---|
| 659,682 | A | 10/1900 | Lepore |
| 894,757 | A | 7/1908 | Spear et al. |
| 1,092,794 | A | 4/1914 | Hughes-Mahone |
| 1,097,530 | A | 5/1914 | Cabelinsky |

(Continued)

FOREIGN PATENT DOCUMENTS

| | | |
|---|---|---|
| KR | 20160127932 | 11/2016 |
| WO | WO-9843890 | 10/1998 |

(Continued)

OTHER PUBLICATIONS

Morpher Hemlet, "Flat-Folding Morpher Helmet", https://www.morpherhelmet.com/ 2017, 8 pages.

(Continued)

*Primary Examiner* — Tajash D Patel
(74) *Attorney, Agent, or Firm* — Strategic Patents, P.C.

(57) ABSTRACT

A collapsible helmet may include a number of chassis segments that are mechanically coupled to one another, where at least some of the chassis segments are collapsible into another chassis segment for storage, and where the chassis segments are expandable so that the helmet is suitable for wearing on a user's head for protection thereof. For example, certain aspects include a three-piece collapsible helmet that has interlocking fingers. In this manner, when the helmet is closed, the interlocking fingers allow the helmet to conveniently fold or collapse into a compact form. Moreover, when the helmet is opened, the interlocking fingers may provide a desired head coverage for protection of a wearer.

19 Claims, 13 Drawing Sheets

(56) References Cited

U.S. PATENT DOCUMENTS

| | | | |
|---|---|---|---|
| 1,163,313 | A | 12/1915 | Blechman |
| 1,179,473 | A | 4/1916 | Taylor |
| 1,252,460 | A | 1/1918 | Linderme |
| 1,349,782 | A | 8/1920 | Navarre |
| 1,608,045 | A | 11/1926 | Stallman |
| 1,665,750 | A | 4/1928 | Marie et al. |
| 1,781,832 | A | 11/1930 | Crenshaw |
| 2,014,324 | A | 9/1935 | Meyer et al. |
| 2,014,814 | A | 9/1935 | Lues |
| 2,221,155 | A | 11/1940 | Stone |
| 2,263,418 | A | 11/1941 | Edna |
| 2,372,715 | A | 4/1945 | John |
| 2,375,655 | A | 5/1945 | Irvin |
| 2,390,352 | A | 12/1945 | Bouchard |
| 2,420,522 | A | 5/1947 | Grand |
| 2,679,256 | A | 5/1954 | Anthony et al. |
| 2,753,878 | A | 7/1956 | Tobias |
| 2,870,451 | A | 1/1959 | Elaine |
| 2,911,652 | A | 11/1959 | Alexander |
| 3,009,159 | A | 11/1961 | Emmet |
| 3,017,009 | A | 1/1962 | Wiggins et al. |
| 3,035,273 | A | 5/1962 | Joseph |
| 3,125,763 | A | 3/1964 | Baker |
| 3,152,874 | A | 10/1964 | Walter |
| 3,208,080 | A | 9/1965 | Ernest |
| 3,284,805 | A | 11/1966 | Seeler |
| 3,314,077 | A | 4/1967 | Marchello |
| 3,339,608 | A | 9/1967 | Brenner |
| 3,353,188 | A | 11/1967 | John |
| 3,373,447 | A | 3/1968 | June |
| 3,604,671 | A | 9/1971 | Walker |
| 3,612,069 | A | 10/1971 | Waters et al. |
| 3,784,984 | A | 1/1974 | Aileo |
| 3,786,519 | A | 1/1974 | Aileo |
| 3,789,427 | A | 2/1974 | Aileo |
| 3,832,789 | A | 9/1974 | Bartram |
| 4,038,759 | A | 8/1977 | Dyer et al. |
| 4,070,102 | A | 1/1978 | Lelouch |
| 4,091,470 | A | 5/1978 | Ryunoshin |
| 4,131,121 | A | 12/1978 | Araki et al. |
| 4,182,324 | A | 1/1980 | Hills |
| 4,398,305 | A | 8/1983 | Kapel |
| 4,486,903 | A | 12/1984 | Krystal |
| 4,508,115 | A | 4/1985 | Warncke |
| 4,556,991 | A | 12/1985 | Margaronis et al. |
| 4,581,774 | A | 4/1986 | Chaise |
| 4,587,676 | A | 5/1986 | Estadella |
| 4,615,052 | A | 10/1986 | Nava |
| 4,638,806 | A | 1/1987 | Bartlett |
| 4,671,452 | A | 6/1987 | Pupp et al. |
| 4,697,289 | A | 10/1987 | Pier |
| 4,769,857 | A | 9/1988 | Cianfanelli et al. |
| 4,794,652 | A | 1/1989 | Piech et al. |
| 5,121,506 | A | 6/1992 | Ulrich |
| 5,123,408 | A | 6/1992 | Gaines |
| 5,129,107 | A | 7/1992 | Lorenzo |
| 5,173,970 | A | 12/1992 | Shifrin |
| 5,369,935 | A | 12/1994 | Lang et al. |
| 5,515,546 | A | 5/1996 | Shifrin |
| 5,566,837 | A | 10/1996 | Lema |
| 5,584,076 | A | 12/1996 | Armstrong |
| 5,604,935 | A | 2/1997 | Nezer |
| 5,822,799 | A | 10/1998 | Kepple |
| 5,915,435 | A | 6/1999 | Wilen et al. |
| 6,159,324 | A | 12/2000 | Watters et al. |
| 6,209,139 | B1 | 4/2001 | Schmidt et al. |
| 6,292,952 | B1 | 9/2001 | Watters et al. |
| 6,322,486 | B1 | 11/2001 | Waechter |
| 6,442,765 | B1 | 9/2002 | Fallon et al. |
| 6,747,802 | B2 | 6/2004 | Bignolles et al. |
| 6,804,831 | B2 | 10/2004 | Guerra |
| 7,104,733 | B2 | 9/2006 | Olafsson |
| 7,676,854 | B2 | 3/2010 | Berger et al. |
| 7,958,572 | B2 | 6/2011 | Loury et al. |
| 8,196,788 | B1 | 6/2012 | Demko et al. |
| 8,308,785 | B2 | 11/2012 | Pierre et al. |
| 8,850,618 | B2 | 10/2014 | Wu |
| D774,256 | S | 12/2016 | Katopis |
| 9,516,910 | B2 | 12/2016 | Szalkowski et al. |
| 9,554,611 | B2 | 1/2017 | Arrouart et al. |
| 11,191,316 | B2 * | 12/2021 | Von Heifner ..... A42B 3/322 |
| 2004/0045078 | A1 | 3/2004 | Puchalski |
| 2004/0098793 | A1 | 5/2004 | Gershenson |
| 2005/0204578 | A1 | 9/2005 | Taylor |
| 2006/0180254 | A1 | 8/2006 | Morley et al. |
| 2007/0056079 | A1 | 3/2007 | Didier |
| 2007/0157370 | A1 | 7/2007 | Joubert |
| 2009/0222976 | A1 | 9/2009 | Loury et al. |
| 2009/0255036 | A1 | 10/2009 | Lim |
| 2009/0281468 | A1 | 11/2009 | Xu |
| 2010/0263671 | A1 | 10/2010 | Walker et al. |
| 2011/0083745 | A1 | 4/2011 | Saito et al. |
| 2011/0265247 | A1 | 11/2011 | Nolan |
| 2012/0076441 | A1 | 3/2012 | Kruse et al. |
| 2012/0317705 | A1 | 12/2012 | Lindsay |
| 2013/0031700 | A1 | 2/2013 | Wacter et al. |
| 2013/0042861 | A1 | 2/2013 | Baek |
| 2013/0089423 | A1 | 4/2013 | Faulkner |
| 2013/0191972 | A1 | 8/2013 | Woolf |
| 2014/0033402 | A1 | 2/2014 | Donnadieu et al. |
| 2015/0121608 | A1 | 5/2015 | Baron et al. |
| 2015/0157083 | A1 | 6/2015 | Lowe |
| 2015/0237947 | A1 | 8/2015 | Ferrando Garcia et al. |
| 2015/0344191 | A1 | 12/2015 | Maurice et al. |
| 2016/0157545 | A1 | 6/2016 | Bowman |
| 2016/0183624 | A1 | 6/2016 | Kim |
| 2018/0064198 | A1 | 3/2018 | Cote |
| 2019/0029357 | A1 | 1/2019 | Bochner |
| 2020/0375299 | A1 | 12/2020 | Von Heifner et al. |

FOREIGN PATENT DOCUMENTS

| | | |
|---|---|---|
| WO | WO-2002080836 | 10/2002 |
| WO | WO-2010005277 | 1/2010 |
| WO | WO-2011132933 | 10/2011 |
| WO | WO-2015056211 | 4/2015 |
| WO | WO-2015185884 | 12/2015 |
| WO | WO-2016060505 | 4/2016 |
| WO | WO-2016142640 | 9/2016 |
| WO | WO-2017006111 | 1/2017 |
| WO | WO-2018200414 | 11/2018 |
| WO | WO-2000016832 A | 3/2020 |

OTHER PUBLICATIONS

Carrera, "Foldable Crit", http://www.carreraworld.com/it/it/sport/car/2015/FOLDABLE-CRIT.E004969EV5558.html 2016, 2 pages.

Overade, "Foldable Helmet", https://www.overade.com/shop/en/ 2016, 6 Pages.

Closca, "Closca Helmet Collection", https://closca.com/collections/closca-helmet-collection 2015, 11 pages.

USPTO, "U.S. Appl. No. 16/607,242 Non-Final Office Action dated Mar. 30, 2021", 8 pages.

USPTO, "U.S. Appl. No. 16/607,242 Notice of Allowance dated Aug. 4, 2021", 6 pages.

WIPO, "PCT Application No. PCT/US18/28945 International Preliminary Report on Patentabilty dated Nov. 7, 2019", 8 pages.

ISA, "PCT Application No. PCT/US18/28945 International Search Report and Written Opinion dated Jul. 5, 2018", 9 pages.

* cited by examiner

COLLAPSIBLE HELMET

CROSS-REFERENCE TO RELATED APPLICATIONS

This application is a continuation of U.S. patent application Ser. No. 16/607,242 filed on Oct. 22, 2019 (now U.S. Pat. No. 11,191,316), which is a national stage entry application of International Patent Application No. PCT/US18/28945 filed on Apr. 23, 2018, which claims priority to U.S. Prov. App. No. 62/490,143 filed on Apr. 26, 2017, and U.S. Prov. App. No. 62/540,245 filed on Aug. 2, 2017, where the entire contents of each of the foregoing applications are hereby incorporated by reference.

FIELD

The present disclosure generally relates to collapsible helmets, and more specifically to helmets that are foldable or otherwise collapsible for storage, mobility, transport, and convenience.

BACKGROUND

While collapsible helmets exist, many are not able to collapse into relatively small sizes while still providing suitable protection and head coverage when expanded for use. There remains a need for improved collapsible helmets.

SUMMARY

A collapsible helmet may include a number of chassis segments that are mechanically coupled to one another, where at least some of the chassis segments are collapsible into another chassis segment for storage, and where the chassis segments are expandable so that the helmet is suitable for wearing on a user's head for protection thereof. For example, certain aspects include a three-piece collapsible helmet that has interlocking fingers. In this manner, when the helmet is closed, the interlocking fingers allow the helmet to conveniently fold or collapse into a compact form. Moreover, when the helmet is opened, the interlocking fingers may provide a desired head coverage for protection of a wearer.

In one aspect, a collapsible helmet disclosed herein may include a center chassis having a substantially concave shape defining a void in an underside thereof shaped and sized to receive a portion of a human head, the center chassis including a first pivot axis and a second pivot axis. The collapsible helmet may also include a first side chassis including a first support rotatably coupled to the center chassis at two ends along the first pivot axis, the first side chassis including a plurality of first fingers extending from the first support toward the center chassis, the plurality of first fingers shaped to move into the void when the first support is rotated adjacent to the center chassis about the first pivot axis. The collapsible helmet may also include a second side chassis including a second support rotatably coupled to the center chassis at two ends along the second pivot axis, the second side chassis including a plurality of second fingers extended from the second support toward the center chassis, the plurality of second fingers shaped to move into the void and interlock with the plurality of first fingers in the void when the second support is rotated adjacent to the center chassis about the second pivot axis.

One or more of the first side chassis and the second side chassis may be lockable from rotation relative to the center chassis. The collapsible helmet may further include a locking mechanism including a locking end engaged with one or more of the plurality of first fingers and the plurality of second fingers, the locking end movable to permit rotation of one or more of the first support and the second support. The locking mechanism may include a first locking end engageable with one or more of the plurality of first fingers and a second locking end engageable with one or more of the plurality of second fingers. The locking mechanism may include a resilient member disposed across the center chassis to engage with both the plurality of first fingers and the plurality of second fingers. The resilient member may include a leaf spring. The locking end may be movable into and out of a groove disposed in one or more of the plurality of first fingers and the plurality of second fingers. The collapsible helmet may further include a shell engaged with one or more of the center chassis, the first side chassis, and the second side chassis. The shell may be exposed on an exterior of one or more of the center chassis, the first side chassis, and the second side chassis. One or more of the center chassis, the first side chassis, and the second side chassis may include one or more indentations, and the shell may be engaged with the one or more indentations. The center chassis, the first side chassis, and the second side chassis may be made of a first material, and the shell may be made of a second material having a hardness greater than that of the first material. The first material may be a foam and the second material may be a plastic. The collapsible helmet may further include a third material engaged with at least a portion of the foam for increasing strength thereof. The third material may include polycarbonate. The collapsible helmet may further include an internal protection system including an internal reinforcement member disposed within one or more of the center chassis, the first side chassis, and the second side chassis. The internal reinforcement member may be disposed within one or more of the plurality of first fingers and the plurality of second fingers. The collapsible helmet may further include a mechanical stop configured to prevent rotation beyond a predetermined amount of one or more of the first support and the second support relative to the center chassis. The mechanical stop may be at least partially disposed on one or more of the plurality of first fingers and the plurality of second fingers. The mechanical stop may be further disposed on the center chassis. The mechanical stop may be at least partially disposed on one or more connections between the center chassis, the first side chassis, and the second side chassis. The collapsible helmet may further include one or more straps that connect the center chassis with the first side chassis and the second side chassis.

In one aspect, a collapsible helmet described herein may include a center chassis having a substantially concave shape defining a void in an underside thereof, a first side chassis including a plurality of first fingers, the first side chassis pivotably engaged with the center chassis about a first pivot axis and rotatable about the first pivot axis from a closed position to an open position, a second side chassis including a plurality of second fingers, the second side chassis pivotably engaged with the center chassis about a second pivot axis and rotatable about the second pivot axis from the closed position to the open position, where, when both the first side chassis and the second side chassis are in the closed position, the plurality of first fingers and the plurality of second fingers interlock with one another within the void in the underside of the center chassis, and where, when both the first side chassis and the second side chassis are in the open position, the center chassis, the first side chassis, and the second side chassis together form a substantially hemispheric shape.

One or more of the first side chassis and the second side chassis may be lockable from movement relative to the center chassis in one or more of the open position and the closed position. The collapsible helmet may further include a locking mechanism including a locking end engaged with one or more fingers in the plurality of first fingers and the plurality of second fingers, the locking end movable to permit pivotal movement of one or more of the plurality of first fingers and the plurality of second fingers relative to the center chassis. The locking mechanism may include a first locking end engageable with one or more of the plurality of first fingers and a second locking end engageable with one or more of the plurality of second fingers. The locking mechanism may include a resilient member disposed across the center chassis to engage with both the plurality of first fingers and the plurality of second fingers. When in the closed position, a majority of the plurality of first fingers and a majority of the plurality of second fingers may be disposed in the void in the underside of the center chassis, and, when in the open position, the majority of the plurality of first fingers and the majority of the plurality of second fingers may be exposed from the underside of the center chassis to form the substantially hemispheric shape. The collapsible helmet may further include a shell engaged with one or more of the center chassis, the first side chassis, and the second side chassis. The collapsible helmet may further include an internal protection system including an internal reinforcement member disposed within one or more of the center chassis, the first side chassis, and the second side chassis. The collapsible helmet may further include a mechanical stop configured to prevent movement beyond a predetermined amount of one or more of the first side chassis and the second side chassis relative to the center chassis. The first side chassis may be disposed on an opposite end of the center chassis relative to the second side chassis. Fingers of the plurality of first fingers and the plurality of second fingers may be radially offset relative to one another to permit collapse of the first side chassis and the second side chassis into the void of the center chassis.

In one aspect, a helmet disclosed herein may include chassis segments mechanically coupled to one another, at least two of the chassis segments rotatable relative to one or more of other chassis segments between an open position and a closed position. The chassis segments, in the open position, may collectively define a substantially hemispheric shape sized and shaped to receive a human head, and, in the closed position, the at least two of the chassis segments may substantially fit within a void defined by the one or more other chassis segments.

The chassis segments may include a center chassis defining the void, a first side chassis, and a second side chassis, where the first side chassis is rotatably coupled to the center chassis at one or more first connections disposed along a first pivot axis and the second side chassis is rotatably coupled to the center chassis at one or more second connections disposed along a second pivot axis. A majority of the first side chassis and a majority of the second side chassis may be movable into the void of the center chassis by rotating the first side chassis about the first pivot axis and rotating the second side chassis about the second pivot axis. Each of the at least two of the chassis segments may include a plurality of fingers that interlock when in the closed position. The helmet may further include a locking mechanism including a locking end engaged with one or more of the at least two of the chassis segments, the locking end movable to permit rotation of one or more of the at least two of the chassis segments. The helmet may further include a shell engaged with one or more of the chassis segments. The helmet may further include an internal protection system including an internal reinforcement member disposed within one or more of the chassis segments. The helmet may further include a mechanical stop configured to prevent rotation beyond a predetermined amount of one or more of the at least two of the chassis segments relative to the one or more other chassis segments.

BRIEF DESCRIPTION OF THE DRAWINGS

The foregoing and other objects, features and advantages of the devices, systems, and methods described herein will be apparent from the following description of particular embodiments thereof, as illustrated in the accompanying drawings. The drawings are not necessarily to scale, emphasis instead being placed upon illustrating the principles of the devices, systems, and methods described herein. In these drawings, like reference numerals identify corresponding elements.

DESCRIPTION

Figure 1:
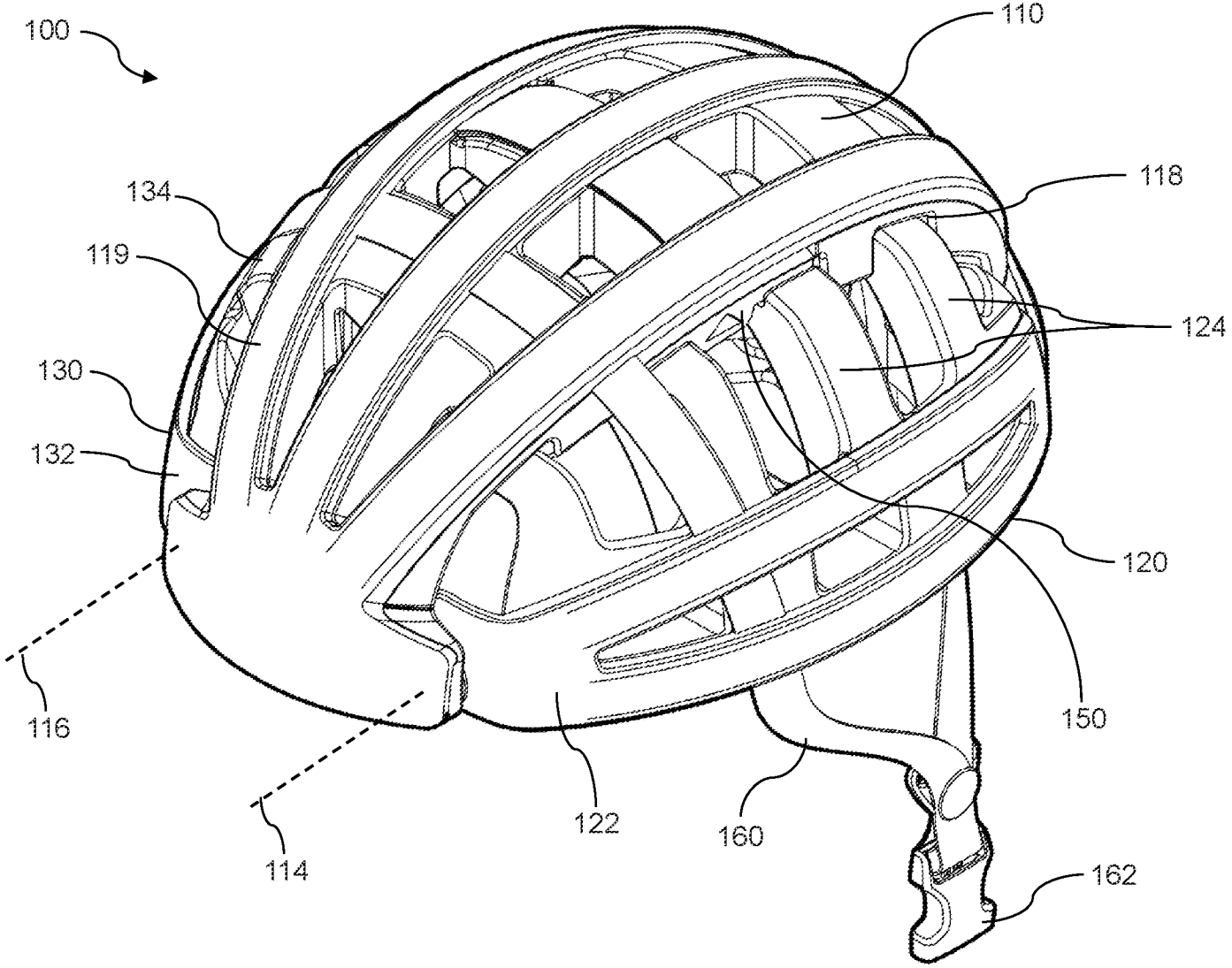
FIG. 1 shows a collapsible helmet in an open position.

The embodiments will now be described more fully hereinafter with reference to the accompanying figures, in which preferred embodiments are shown. The foregoing may, however, be embodied in many different forms and should not be construed as limited to the illustrated embodiments set forth herein. Rather, these illustrated embodiments are provided so that this disclosure will convey the scope to those skilled in the art.

All documents mentioned herein are hereby incorporated by reference in their entirety. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately" or the like, when accompanying a numerical value, are to be construed as indicating a deviation as would be appreciated by one of ordinary skill in the art to operate satisfactorily for an intended purpose. Similarly, words of approximation such as "approximately" or "substantially" when used in reference to physical characteristics, should be understood to contemplate a range of deviations that would be appreciated by one of ordinary skill in the art to operate satisfactorily for a corresponding use, function, purpose, or the like. Ranges of values and/or numeric values are provided herein as examples only, and do not constitute a limitation on the scope of the described embodiments. Where ranges of values are provided, they are also intended to include each value within the range as if set forth individually, unless expressly stated to the contrary. The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

In the following description, it is understood that terms such as "first," "second," "top," "bottom," "up," "down," and the like, are words of convenience and are not to be construed as limiting terms.

Described herein are devices, systems, and methods for collapsible helmets, e.g., a three-piece folding helmet that has interlocking fingers. In certain aspects, when the helmet is closed, the interlocking fingers allow the helmet to conveniently fold or collapse into a compact form. Moreover, in certain aspects, when the helmet is open, the interlocking fingers may provide a desired head coverage for protection of the wearer.

A "helmet" as used throughout this disclosure will be understood to include protective gear intended to be worn on a user's head (e.g., a human user) to protect the user's head from injuries such as brain injuries, abrasions, and the like. Although a preferred embodiment of a collapsible helmet as described herein may be for protecting a wearer's head when cycling (e.g., using a bicycle or the like) or other transportation (e.g., via skateboard, roller skates, roller blades, scooter, motorized pedestrian vehicles, and so on), it will be understood that the helmets described herein may also or instead be used for other activities including without limitation recreational activities, work activities, other forms of transportation, military engagement and military exercises, sports, and so on, or generally any activity where a user desires head protection in a collapsible, and thus easily storable and transportable, form. It will further be understood that a helmet as described herein may be designed such that it conforms to relevant safety standards for helmets, such as U.S. Consumer Product Safety Commission (CPSC) standards and European Economic Area (EEA) Conformité Européenne (CE) (i.e., meaning "European Conformity") standards for "pedal cyclists, and users of skateboards and roller skates," and the like.

In general, a collapsible helmet described herein may include a plurality of chassis and interlocking fingers. For example, a collapsible helmet may include three chassis, where two outer (side) chassis move relative to a center chassis, and where the two outer chassis each include fingers that are capable of interlocking once the two outer chassis are rotated inwards toward the center chassis. Conversely, when the outer chassis are rotated outwards away from the center chassis, the fingers may disengage from an interlocking position and the collapsible helmet may be opened so that it can be worn by a wearer upon their head. When the collapsible helmet is fully open, the fingers may provide desirous protective coverage for a wearer's head.

Figure 2:
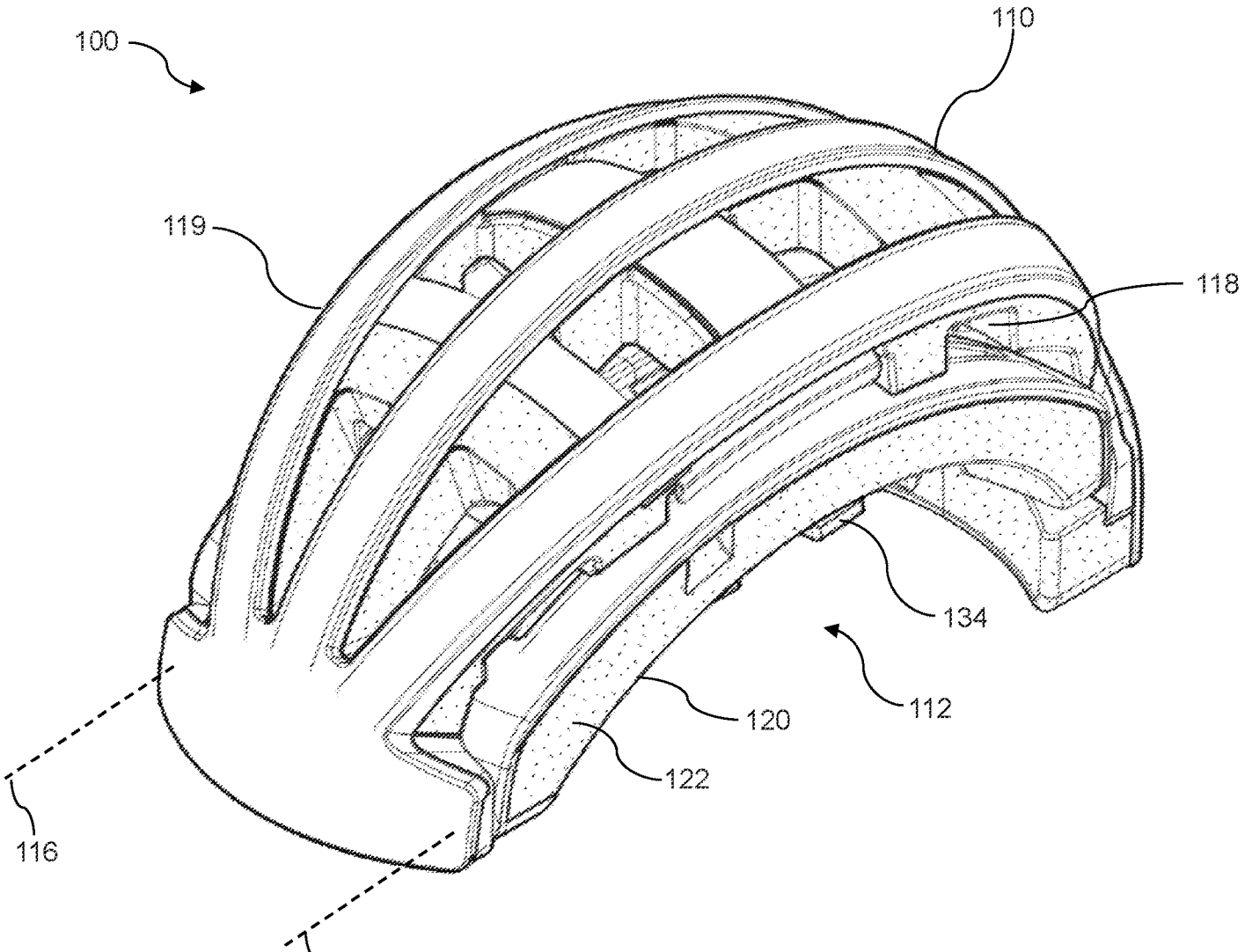
FIG. 2 shows a collapsible helmet in a closed position.

FIG. 1 shows a collapsible helmet in an open position, and FIG. 2 shows the collapsible helmet in a closed position. Specifically, the helmet 100 may be movable and configurable from an open position (e.g., as shown in FIG. 1) to a closed position (e.g., as shown in FIG. 2) and vice-versa, where a user can wear the helmet 100 on his/her head for protection thereof in the open position, and where the helmet 100 can be collapsed into the closed position for storage, mobility, convenience, and so on. To this end, the helmet 100 may include a number of chassis engaged and movable relative to one another to accommodate adjusting the helmet 100 between the open and closed positions. For example, the helmet 100 may include at least three chassis—a center chassis 110, a first side chassis 120, and a second side chassis 130.

The center chassis 110 may generally have a substantially concave shape defining a void 112 in an underside thereof, where the void 112 is shaped and sized to receive at least a portion of a human head. More specifically, the void 112 may be able to accommodate a human head when the helmet 100 is in the open position. The void 112 may also serve to receive fingers of the first side chassis 120 and the second side chassis 130 that interlock within the void 112 when the helmet 100 is in the closed position, thereby providing a size and a shape for the helmet 100 in the closed position that generally resembles the size and the shape of the center chassis 110 itself That is, in the closed position, the helmet 100 may be able to fit within a volume that is substantially equal to a volume that the center chassis 110 itself would be able to fit within. The helmet 100 may also or instead occupy substantially the same footprint in the closed position as the center chassis 110 itself would occupy. The center chassis 110 may include a number of ribs 119 formed thereon that define the shape of the center chassis 110 and provide support thereto, e.g., three or four ribs 119.

To accommodate movement of the first side chassis 120 and the second side chassis 130 relative to the center chassis 110, the center chassis 110 may include a first pivot axis 114 and a second pivot axis 116. That is, the first side chassis 120 may be rotatably coupled to the center chassis 110 along the first pivot axis 114, and the second side chassis 130 may be rotatably coupled to the center chassis 110 along the second pivot axis 116. In general, the first side chassis 120 may be coupled to, and disposed on, an opposite end of the center chassis 110 relative to the second side chassis 130.

The first side chassis 120 may include a first support 122 and a plurality of first fingers 124. The first support 122 may be rotatably coupled to the center chassis 110 at two ends along the first pivot axis 114, where the first support 122 is movable to facilitate the helmet 100 being in either the open or closed position. In general, the first support 122 may define a support structure or housing to which the first fingers 124 are engaged or from which the first fingers 124 extend. For example, one or more of the first fingers 124 may extend from the first support 122 toward the center chassis 110.

The second side chassis 130 may include a second support 132 and a plurality of second fingers 134. The second side chassis 130 may be rotatably coupled to the center chassis 110 at two ends along the second pivot axis 116, where the second support 132 is movable to facilitate the helmet 100 being in either the open or closed position. In general, the second support 122 may define a support structure or housing to which the second fingers 134 are engaged or from which the second fingers 134 extend. For example, one or more of the second fingers 134 may extend from the second support 132 toward the center chassis 110.

The second side chassis 130 may be the same or substantially similar to the first side chassis 120, but for being disposed on an opposite side of the center chassis 110 from the first side chassis 120, and but for having the second fingers 134 radially offset from the first fingers 124 to enable interlocking in the void 112 as described herein.

The first fingers 124 may be shaped to move into the void 112 when the first support 122 is rotated to be adjacent to the center chassis 110 about the first pivot axis 114, and the second fingers 134 may be shaped to move into the void 112 and interlock with the first fingers 124 in the void 112 when the second support 132 is rotated to be adjacent to the center chassis 110 about the second pivot axis 116.

To accommodate receiving the first fingers 124 and the second fingers 134 within the void 112, the center chassis 110 may include one or more slots 118 formed therein. The slots 118 or other portions of the helmet 100 may include features structurally configured for engagement with the fingers for securement, guiding, locking, and the like. Thus, in this manner, one or more of the first side chassis 120 and the second side chassis 130 may be lockable from rotation relative to the center chassis 110. The locking of one or more of the first side chassis 120 and the second side chassis 130 relative to center chassis 110 may be provided by a locking mechanism 150, which is described in greater detail below. In certain implementations, the locking mechanism 150 may cause the helmet 100 to automatically lock into place when placed into the open position by a user, and/or when placed into the closed position by a user.

The helmet 100 may further include one or more straps 160, e.g., nylon straps or the like. The straps 160 may be threaded through each of the chassis that form the helmet 100, e.g., for securing the helmet 100 to a user's head using one or more connectors 162 (e.g., a buckle or the like as shown in the figure). In certain implementations, one or more of the straps 160 may be continuous between its ends. In this manner, the straps 160 may also or instead be used for connecting the chassis to one another—e.g., one or more straps may connect the center chassis 110 with the first side chassis 120 and the second side chassis 130.

Figure 3:
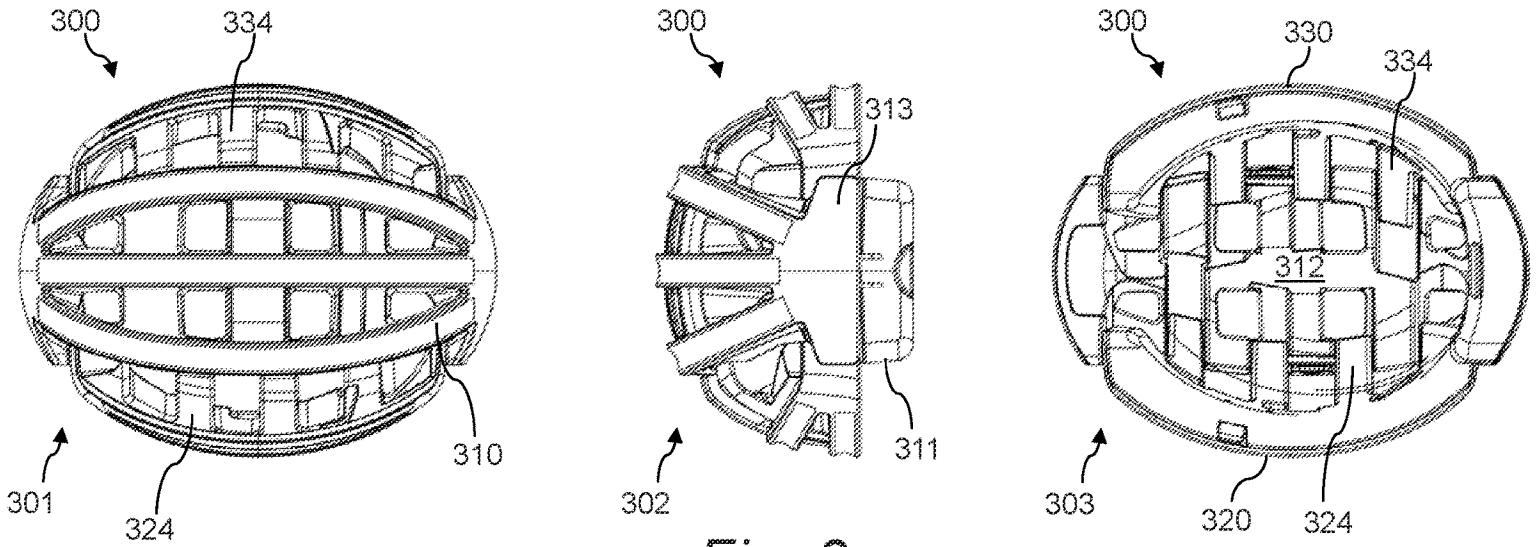
FIG. 3 shows various views of a collapsible helmet in an open position.
Figure 4:
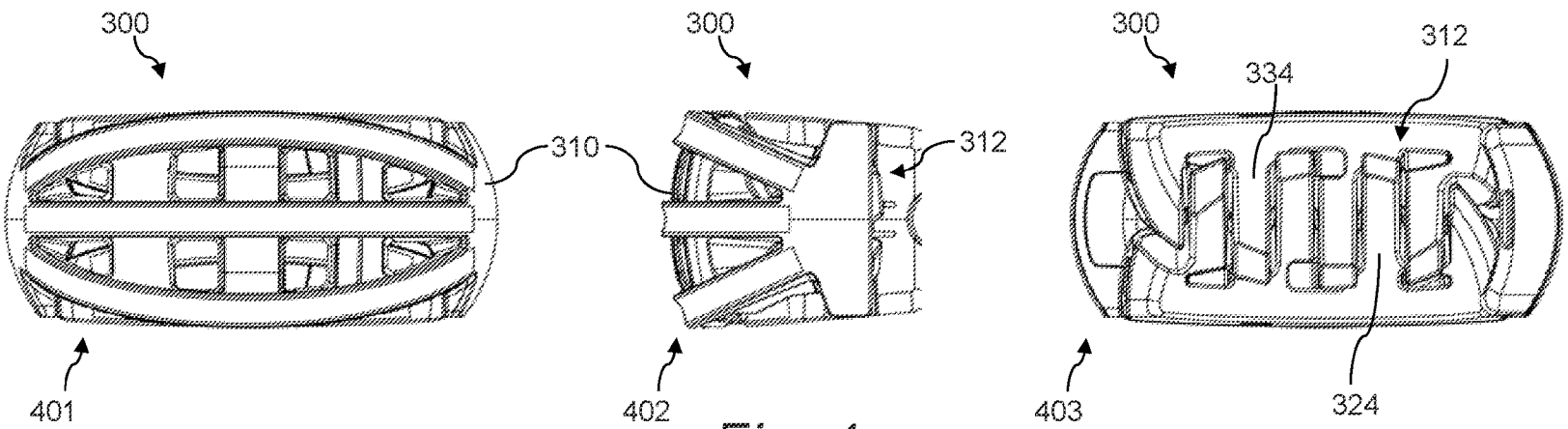
FIG. 4 shows various views of a collapsible helmet in a closed position.

FIG. 3 shows various views of a collapsible helmet in an open position, and FIG. 4 shows various views of the collapsible helmet in a closed position. The helmet 300 may be the same collapsible helmet, or a substantially similar collapsible helmet, to that shown in FIGS. 1 and 2 described above.

Specifically, in FIG. 3, a top view 301 of the helmet 300, a front view 302 of the helmet 300, and a bottom view 303 of the helmet 300 are shown, where the helmet 300 is in the open position, i.e., suitable for wearing by a user for head protection or the like. Similarly, in FIG. 4, a top view 401 of the helmet 300, a front view 402 of the helmet 300, and a bottom view 403 of the helmet 300 are shown, where the helmet 300 is in the closed position, i.e., suitable for storage, carrying, transport, and the like.

As shown in the top view 301 of the helmet 300 in FIG. 3, in certain implementations, when in the open position, the majority of the plurality of first fingers 324 and the majority of the plurality of second fingers 334 may be exposed from the underside of the center chassis 310 to form a substantially hemispheric shape for the helmet 300 overall. As shown in the bottom view 403 of the helmet 300 in FIG. 4, in certain implementations, when in the closed position, a majority of the plurality of first fingers 324 and a majority of the plurality of second fingers 334 may be disposed in a void 312 in the underside of the center chassis 310. The fingers (i.e., the plurality of first fingers 324 and the plurality of second fingers 334) may be radially offset relative to one another to permit the collapse of the first side chassis 320 and the second side chassis 330 into the void 312 of the center chassis 310.

As shown in the front view 302 of the helmet 300 in FIG. 3, the helmet 300 (e.g., the center chassis 310) may include a rear portion 311 that protrudes downward relative to a front portion 313. The rear portion 311 may provide additional protection to the head of a wearer of the helmet 300.

Figure 5:
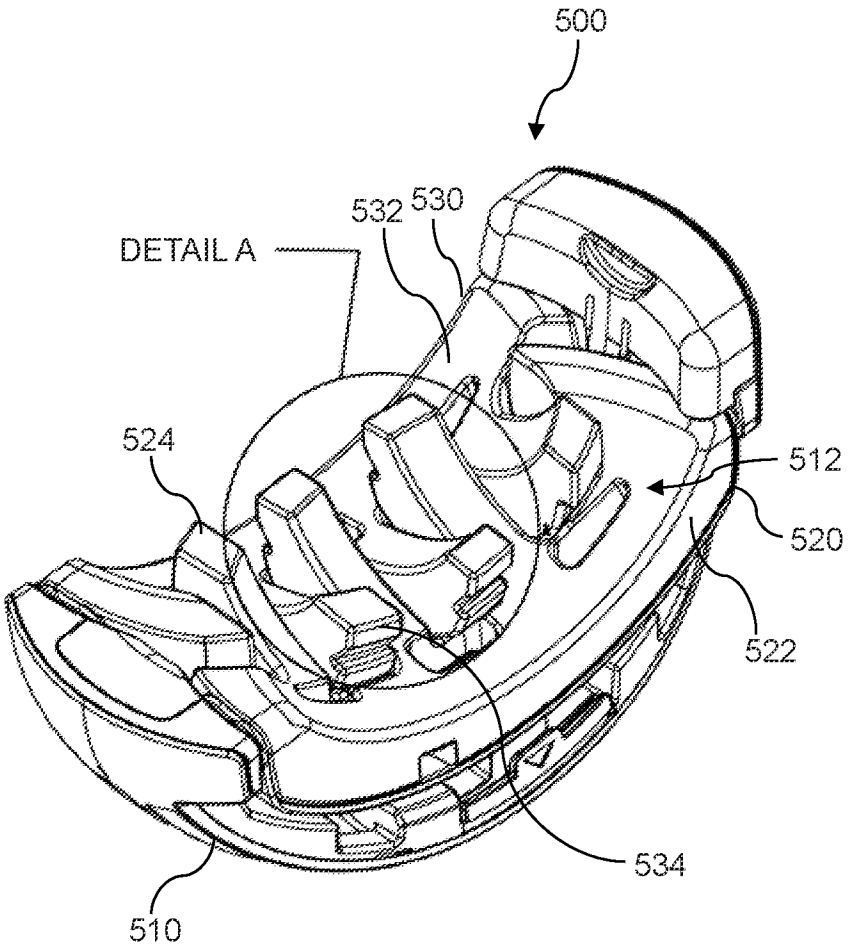
FIG. 5 shows the underside of a collapsible helmet in a closed position.

FIG. 5 shows the underside of a collapsible helmet in a closed position. The helmet 500 may be the same or similar to any of the other helmets shown and described herein. For example, the helmet 500 may include a center chassis 510, a first side chassis 520 having a first support 522 and a plurality of first fingers 524, and a second side chassis 530 having a second support 532 and a plurality of second fingers 534. As shown in the figure, when the helmet 500 is in the closed position, the first side chassis 520 and the second side chassis 530 may be substantially fully disposed within the void 512 of the center chassis 510. Thus, the helmet 500 may be able to become more compact than other, existing collapsible helmets, which can be advantageous for storage, transport, and so forth.

Figure 6:
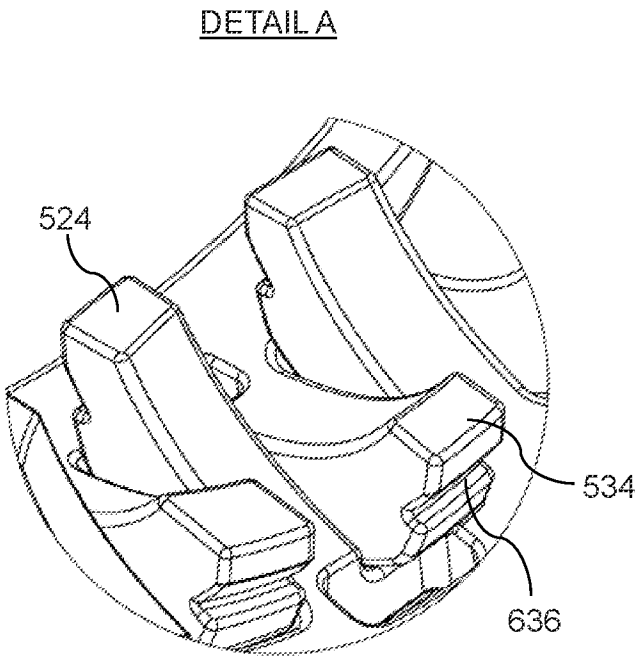
FIG. 6 shows Detail A of the collapsible helmet of FIG. 5.

FIG. 6 shows Detail A of the collapsible helmet of FIG. 5. As shown in the figure, one or more of the fingers (e.g., each of the fingers) may include a groove 636 or other indentation that can be used for receiving a cooperating protrusion on the center chassis thereby preventing movement of the side chassis beyond a predetermined amount. In this manner, the helmet may not be opened beyond a predisposed position, e.g., the open position shown and described herein.

Figure 7:
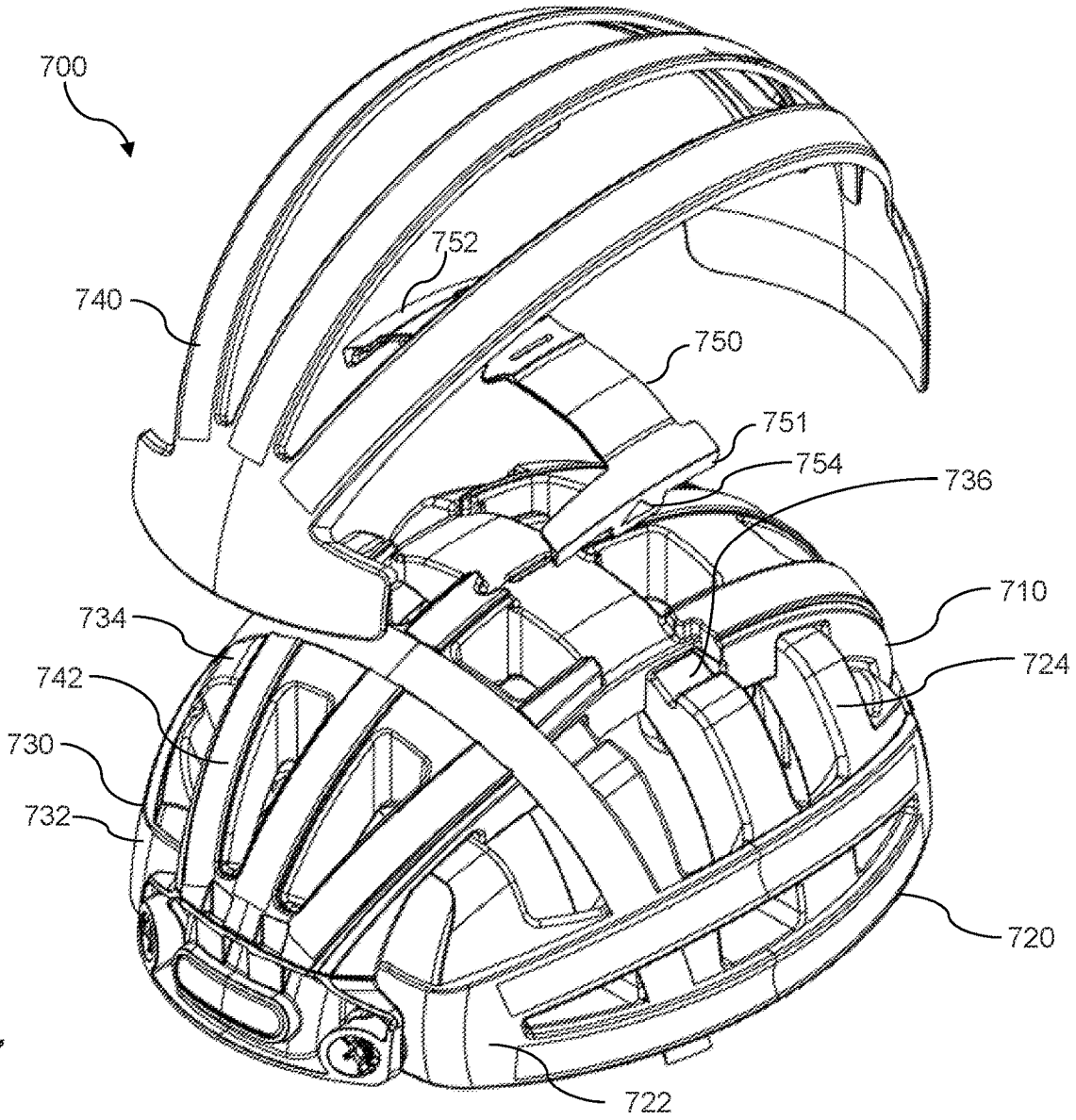
FIG. 7 shows a collapsible helmet with a locking mechanism and a shell separated from the helmet.

FIG. 7 shows a collapsible helmet with a locking mechanism and a shell separated from the helmet. The helmet 700 may be the same or similar to any of the other helmets shown and described herein. For example, the helmet 700 may include a center chassis 710, a first side chassis 720 having a first support 722 and a plurality of first fingers 724, and a second side chassis 730 having a second support 732 and a plurality of second fingers 734. As shown in the figure, the helmet 700 may further include a shell 740 for strength or reinforcement of the helmet 700. The shell 740 may also or instead serve to hold one or more components of the helmet 700 in place, such as the locking mechanism 750.

As discussed herein, one or more of the first side chassis 720 and the second side chassis 730 may be lockable from rotation relative to the center chassis 710. To this end, the helmet 700 may include a locking mechanism 750 as described herein. The locking mechanism 750 may be disposed on the center chassis 710 (or otherwise engaged with the center chassis 710), where the locking mechanism 750 is configurable to engage with one or more of the fingers of the side chassis, and/or with another portion of the side chassis such as the supports. For example, the locking mechanism 750 may be relatively pliable to move into and out of engagement with one or more of the fingers of the side chassis for locking a position of one or more of the side chassis relative to the center chassis 710.

Thus, the locking mechanism 750 may include one or more locking ends (e.g., a first locking end 751 and a second locking end 752) structurally configured for engagement with one or more of the side chassis. For example, the locking ends may be structurally configured for engagement with the fingers or supports of the side chassis. In certain implementations, a locking end of the locking mechanism 750 is structurally configured for engagement with one or more of the plurality of first fingers 724 and the plurality of second fingers 734, where the locking end is movable (e.g., into and out of engagement with one or more fingers) to permit rotation of one or more of the first support 722 and the second support 732. For example, each end of the locking mechanism 750 may be engageable with a side chassis—the locking mechanism 750 may include a first locking end 751 engageable with one or more of the first fingers 724 and a second locking end 752 engageable with one or more of the second fingers 734.

As stated above, the locking mechanism 750 may be relatively pliable, at least on its ends, for movement into and out of engagement with a finger of a side chassis. In this manner, the locking mechanism 750 may include a resilient member or body disposed across the center chassis 710 to engage with both the first fingers 724 and the second fingers 734. The resilient member or body of the locking mechanism 750 may thus include a leaf spring in certain implementations. In this manner, one or more of the locking ends of the locking mechanism 750 may be movable into and out of a groove 736 disposed in one or more of the fingers. To accommodate engagement with the groove 736 of a finger, the locking end may include a protrusion 754 or the like.

The locking member 750 may also or instead include one or more other features or components for releasable engagement with the side chassis (e.g., the fingers or the supports). For example, the locking member 750 may also or instead include a latch (e.g., slidable or rotatable), a pin, a clamp, a clip, a gib, a friction fit, a hook, a fastener (e.g., hook and loop), a screw, a slider, a snap, and so on.

As discussed above, the helmet 700 may include a shell 740 engaged with one or more of the center chassis 710, the first side chassis 720, and the second side chassis 730. The shell 740 may be exposed on an exterior of one or more of the center chassis 710, the first side chassis 720, and the second side chassis 730. For example, one or more of the center chassis 710, the first side chassis 720, and the second side chassis 730 may include one or more indentations 742, where the shell 740 is engaged with the indentations 742. In this manner, the shell 740 may be disposed at least partially within the indentations 742, or be molded around the indentations 742 or other support structure of the chassis. In other aspects, the shell 740 may also or instead be disposed within an interior of one or more of the chassis, or the shell 740 may be integral with one or more of the chassis. In some aspects, the shell 740 may be used for joining multiple parts of the helmet 700 together.

In certain implementations, the shell 740 is made from a substantially hard material thereby providing a predetermined strength and rigidity to the helmet 700. For example, one or more of the center chassis 710, the first side chassis 720, and the second side chassis 730 may be made of a first material, where the shell 740 is made of a different, second material having a hardness greater than that of the first material. In certain aspects, the first material is a foam, which may be advantageous for shock absorption or the like, and the second material is a plastic, e.g., acrylonitrile butadiene styrene (ABS) plastic or the like for strength. In implementations where the first material is foam, the helmet 700 may further include a third material engaged with at least a portion of the foam for increasing strength thereof, such as a polycarbonate or similar that is molded onto an exterior surface of the foam.

Figure 8:
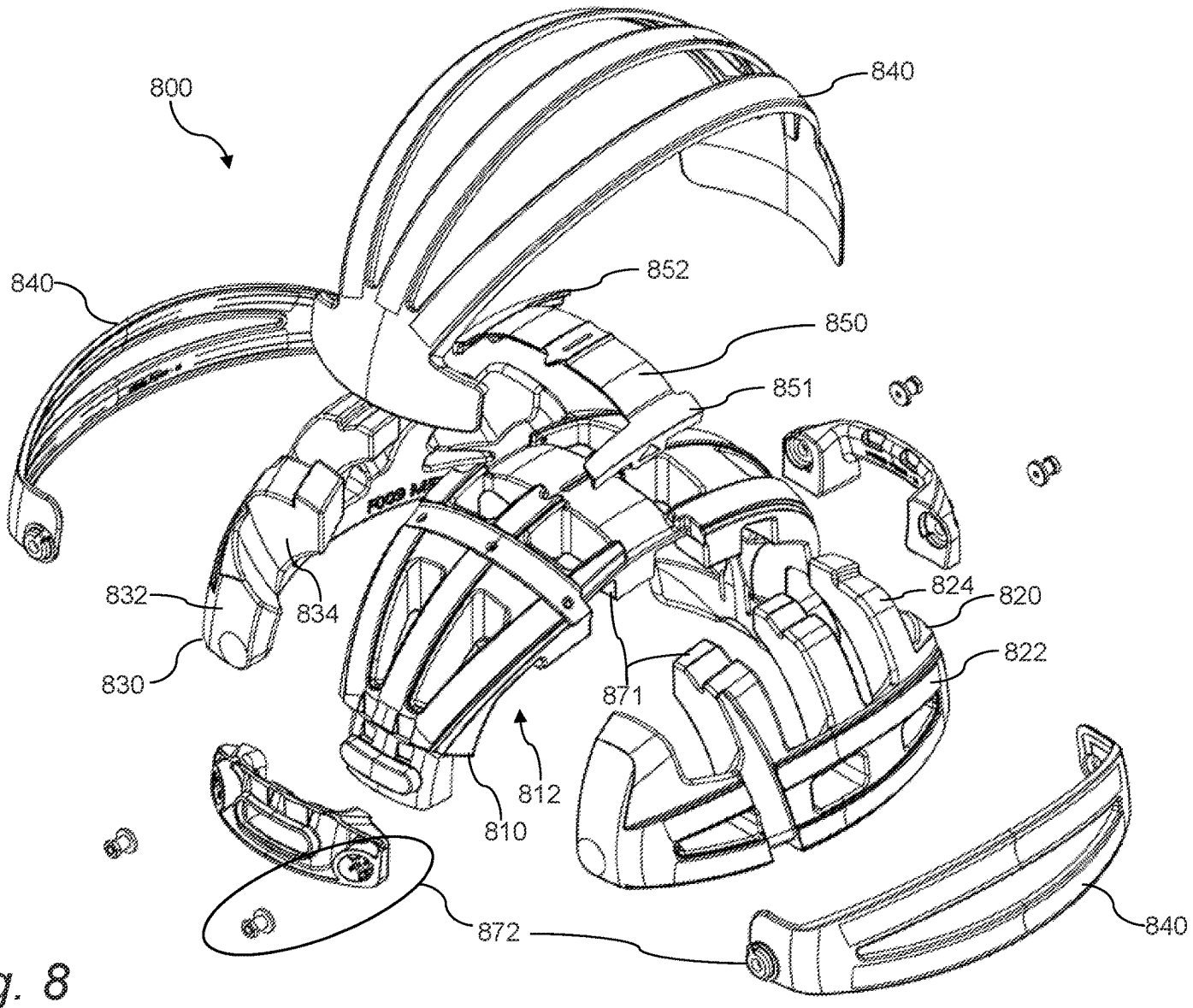
FIG. 8 shows a perspective exploded view of a collapsible helmet.
Figure 9:
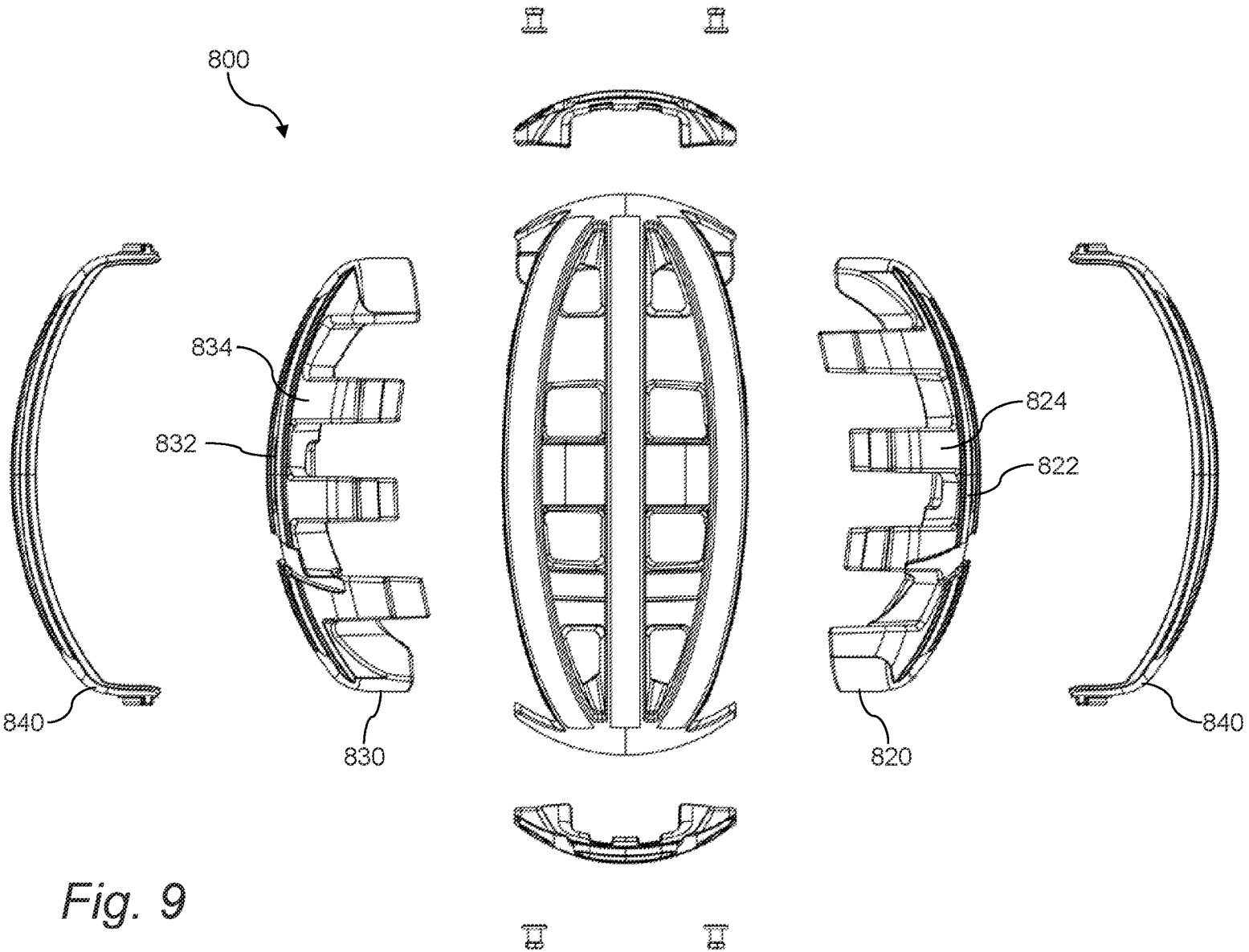
FIG. 9 shows a top exploded view of a collapsible helmet.
Figure 10:
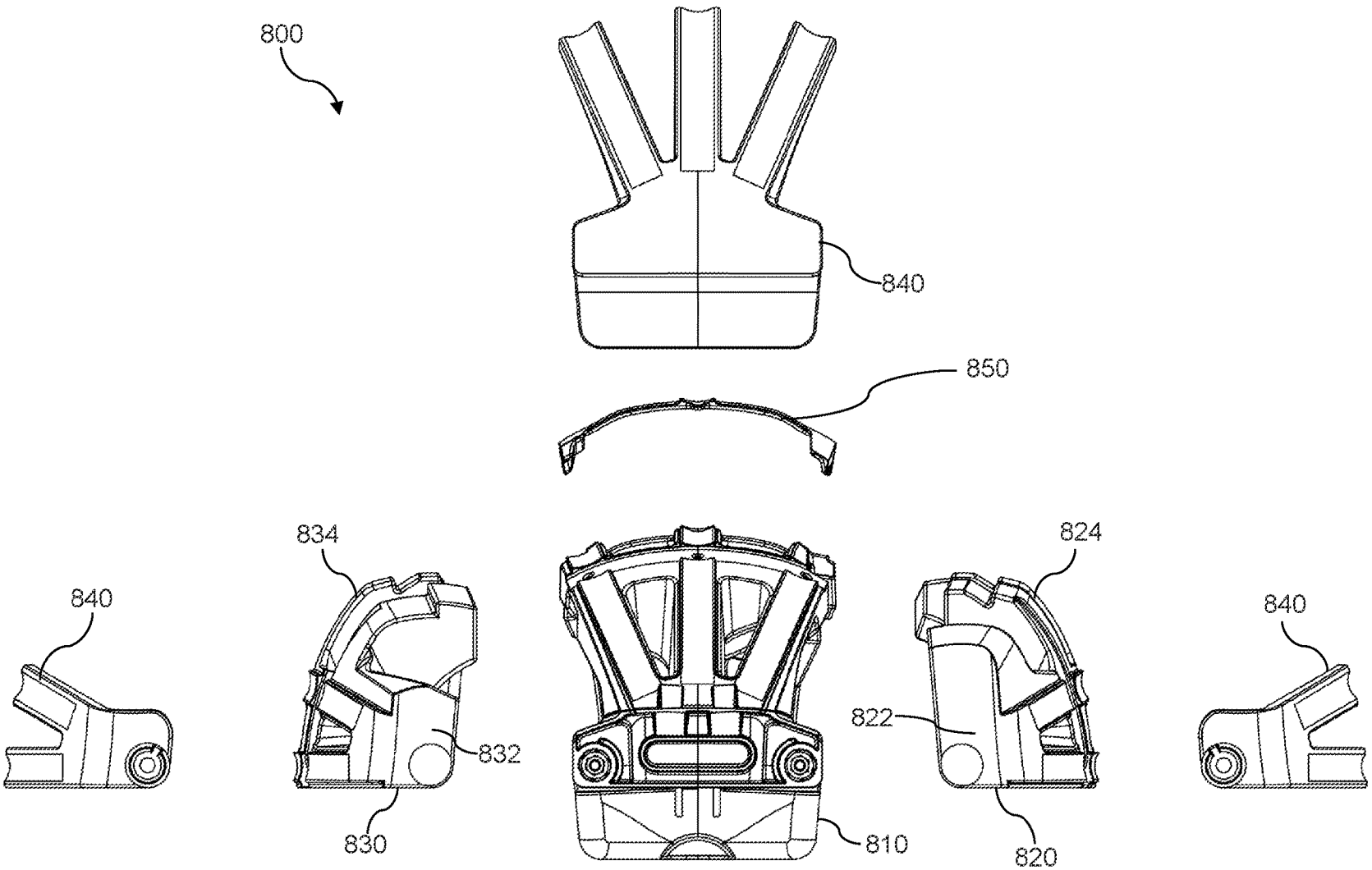
FIG. 10 shows a front exploded view of a collapsible helmet.

FIG. 8 shows a perspective exploded view of a collapsible helmet, FIG. 9 shows a top exploded view of the collapsible helmet, and FIG. 10 shows a front exploded view of the collapsible helmet. The helmet 800 may be the same or similar to any of the other helmets shown and described herein. For example, the helmet 800 may generally include a center chassis 810, a first side chassis 820, a second side chassis 830, a shell 840, and a locking mechanism 850.

As shown in the figure, the center chassis 810 may have a substantially concave shape defining a void 812 in an underside thereof. The first side chassis 820 may include a plurality of first fingers 824 as described herein, e.g., attached to or extending from a first support 822. The first side chassis 820 may be pivotably engaged with the center chassis 810 about a first pivot axis, where the first side chassis 820 is rotatable about the first pivot axis from a closed position to an open position, and vice-versa. Similarly, the second side chassis 830 may include a plurality of second fingers 834 as described herein, e.g., attached to or extending from a second support 832. The second side chassis 830 may be pivotably engaged with the center chassis 810 about a second pivot axis, where the second side chassis 830 is rotatable about the second pivot axis from a closed position to an open position, and vice-versa. As described and shown herein, when both the first side chassis 820 and the second side chassis 830 are in the closed position, the first fingers 824 and the second fingers 834 may interlock with one another within the void 812 in the underside of the center chassis 810. Also, when both the first side chassis 820 and the second side chassis 830 are in the open position, the structure of the helmet 800 may resemble a substantially hemispheric shape. That is, cumulatively, the center chassis 810, the first side chassis 820, and the second side chassis 830 together may form a substantially hemispheric shape in the closed position.

As discussed herein, one or more of the first side chassis 820 and the second side chassis 830 may be lockable from movement relative to the center chassis 810 in one or more of the open position and the closed position. To this end, the helmet 800 may include a locking mechanism 850. The locking mechanism 850 may include a locking end engaged with one or more fingers in the plurality of first fingers 824 and the plurality of second fingers 834, where the locking end is movable to permit or restrict pivotal movement of the fingers relative to the center chassis 810. In this manner, the locking mechanism 850 may include a first locking end 851 that is engageable with one or more of the first fingers 824 and a second locking end 852 that is engageable with one or more of the second fingers 834. As shown in the figure, the locking mechanism 850 may include a resilient member disposed across the center chassis 810 to engage with both a first finger 824 and a second finger 834.

The shell 840 is clearly visible in FIGS. 8-10. As shown in these figures, the shell 840 may be structurally configured for engagement with one or more of the center chassis 810, the first side chassis 820, and the second side chassis 830. The shell 840 may include several different pieces (e.g., a separate piece for each chassis to enable collapsibility of the chassis when engaged with the shell 840), or the shell 840 may be only one piece (e.g., a shell 840 that is applied to the helmet 800 in the open position, where the shell 840 may be removable to permit collapsing the helmet 800 into the closed position).

As discussed herein, and as explained in more detail with reference to FIGS. 12-14, the helmet 800 may include one or more mechanical stops configured to prevent movement beyond a predetermined amount of one or more of the first side chassis 820 and the second side chassis 830 relative to the center chassis 810. In other words, the mechanical stops may include hard stops that prevent the helmet 800 from opening further than intended, e.g., opening to a first predetermined size, or from closing further than intended, e.g., closing to a second predetermined size. The mechanical stops may include a first set of mechanical features 871 disposed on one or more of the fingers and the center chassis 810. The mechanical stops may also or instead include a second set of mechanical features 872 disposed on or near connection points between the side chassis and the center chassis 810.

Figure 11:
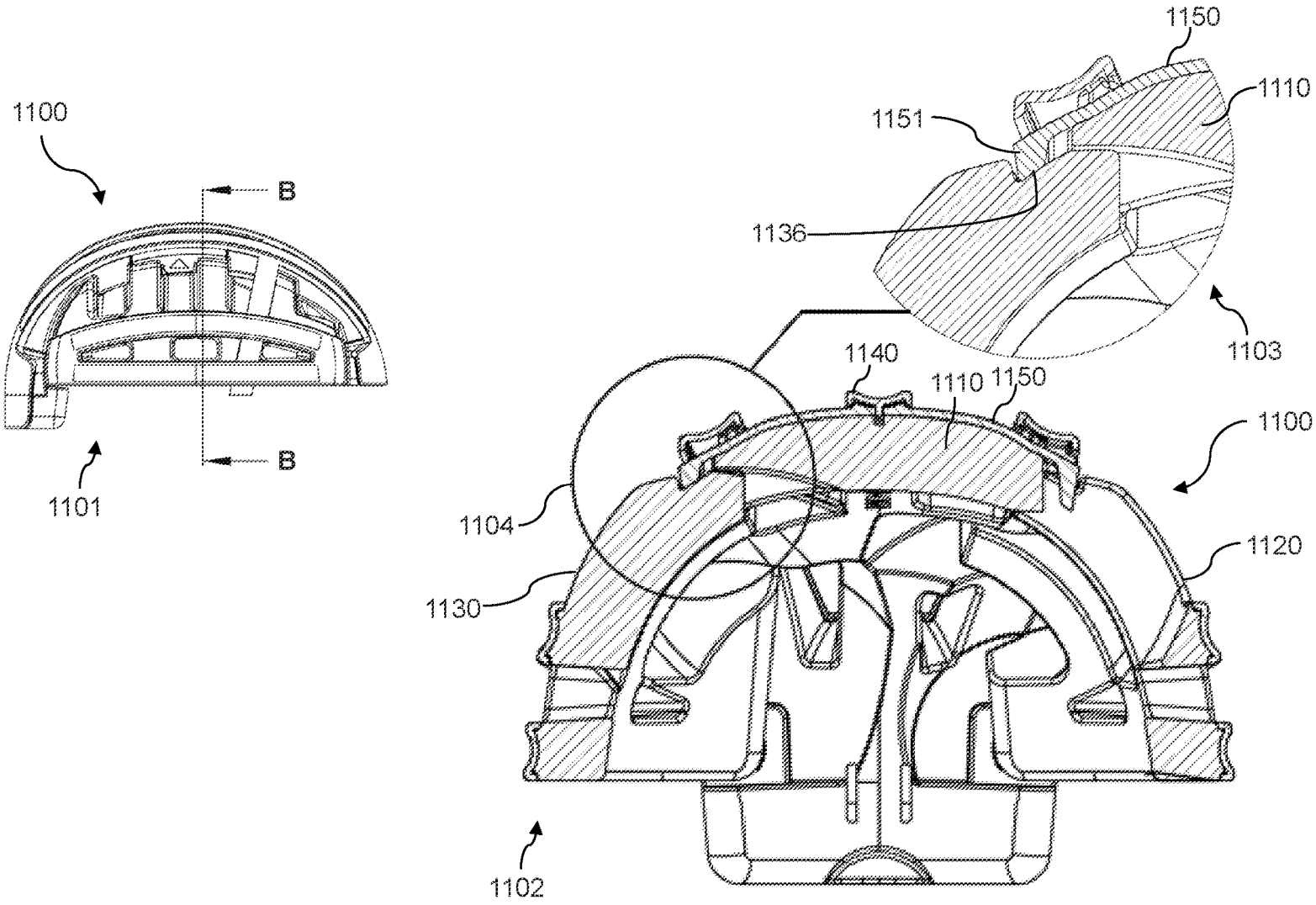
FIG. 11 shows a cross-sectional view and detail of a collapsible helmet.

FIG. 11 shows a cross-sectional view and detail of a collapsible helmet. Specifically, the figure shows a first view 1101 of a helmet 1100, a second view 1102 of the helmet 1100 through Section B-B of the first view 1101, and a third view 1103 showing a detailed look at the encircled area 1104 of the second view 1102. The helmet 1100 may be the same or similar to any of the other helmets shown and described herein. For example, the helmet 1100 may generally include a center chassis 1110, a first side chassis 1120, a second side chassis 1130, a shell 1140, a locking mechanism 1150, and so on.

The locking mechanism 1150 may be configured to automatically lock the helmet 1100 in a predetermined configuration, e.g., the open position or the closed position as described herein. For example, the locking mechanism 1150 may be configured such that, when one or more of the first side chassis 1120 and the second side chassis 1130 are rotated outward from the closed position to the open position, and when the helmet 1100 is fully opened, an end 1151 of the locking mechanism 1150 is engaged with a recess or groove 1136 on one or more of the fingers. In this manner, the locking mechanism 1150 may act as a physical barrier preventing or retraining further movement of one or more of the side chassis. The locking mechanism 1150 may thus act as a retention system or component preventing the helmet 1100 from closing when in its open position. Once the ends 1151 of the locking mechanism 1150 are lifted on both sides of the center chassis 1110, the side chassis may be capable of rotating toward the center chassis 1110, thus allowing for the helmet 1100 to collapse into the closed position, e.g., for storage or the like.

Figure 12:
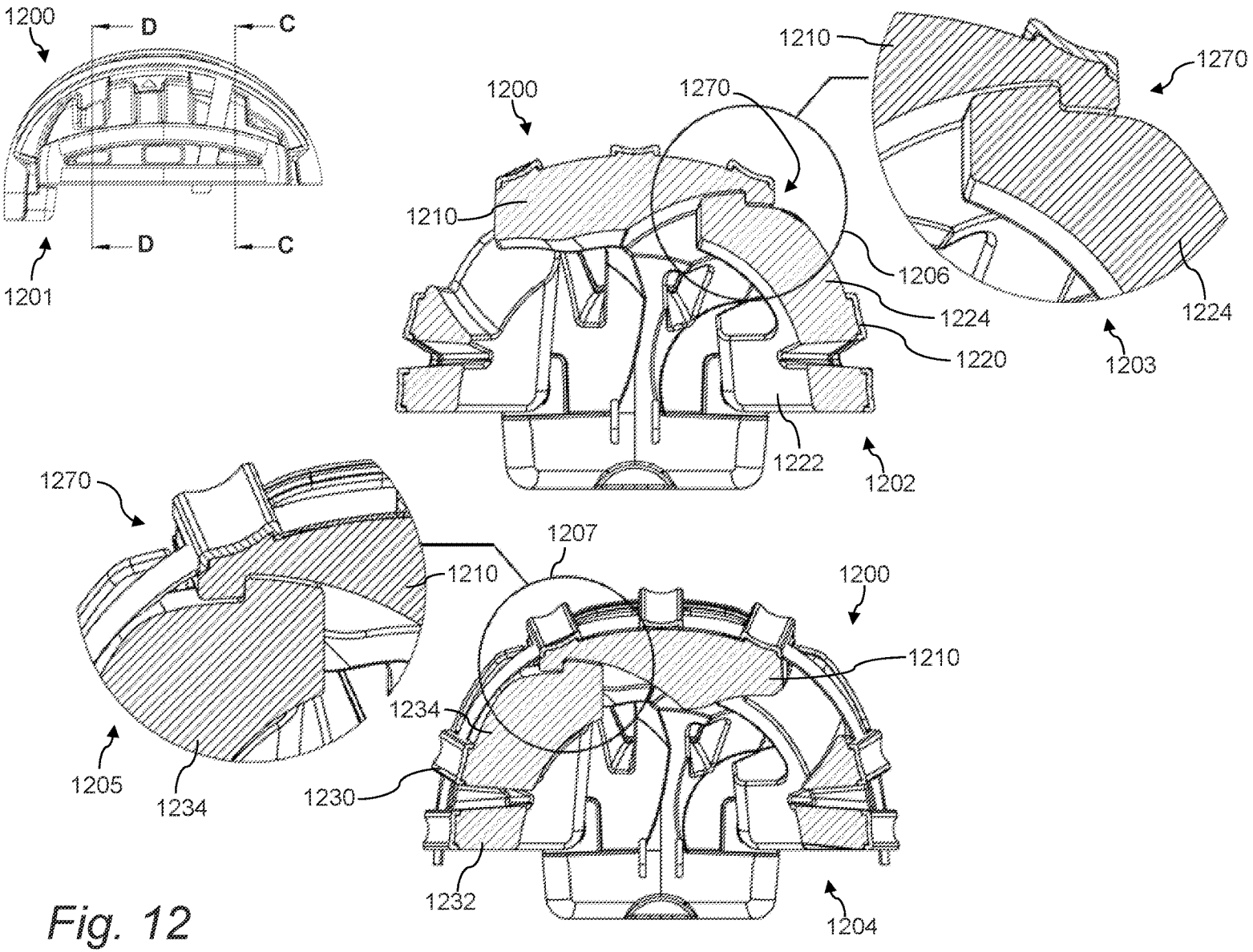
FIG. 12 shows cross-sectional views and details of a collapsible helmet.

FIG. 12 shows cross-sectional views and details of a collapsible helmet. Specifically, the figure shows a first view 1201 of a helmet 1200, a second view 1202 of the helmet 1200 through Section C-C of the first view 1201, a third view 1203 showing a detailed look at the first encircled area 1206 of the second view 1202, a fourth view 1204 of the helmet 1200 through Section D-D of the first view 1201, and a fifth view 1205 showing a detailed look at the second encircled area 1207 of the fourth view 1204. The helmet 1200 shown in the various views of FIG. 12 may be the same or similar to any of the other helmets shown and described herein. For example, the helmet 1200 may include a center chassis 1210, a first side chassis 1220 having a first support 1222 and a plurality of first fingers 1224, and a second side chassis 1230 having a second support 1232 and a plurality of second fingers 1234.

As discussed herein, the helmet 1200 may include one or more mechanical stops to prevent movement beyond a predetermined amount of one or more of the first side chassis 1220 and the second side chassis 1230 relative to the center chassis 1210. Thus, the various views of FIG. 12 show a first mechanical stop 1270 that may be included on helmets as described herein. More specifically, a helmet 1200 may include one or more such first mechanical stops 1270, where the first mechanical stops 1270 are configured to prevent rotation beyond a predetermined amount of one or more of the first side chassis 1220 (e.g., the first support 1222 of the first side chassis 1220) and the second side chassis 1230 (e.g., the second support 1232 of the second side chassis 1230) relative to the center chassis 1210. In this manner, the first mechanical stops 1270 may be configured to prevent the helmet 1200 from opening further than intended when placed into the open position, and/or from closing further than intended when placed into the closed position.

As shown in the various views of FIG. 12, in certain implementations, the first mechanical stop 1270 may be at least partially disposed on one or more of the first fingers 1224 and the second fingers 1234. Further, the first mechanical stop 1270 may also or instead be disposed on the center chassis 1210. That is, the first mechanical stop 1270 may be at least partially formed at a location of engagement between the fingers and the center chassis 1210.

As shown in the second view 1202 and the third view 1203 of FIG. 12, one or more of the first fingers 1224 of the first side chassis 1220 may mechanically engage with the center chassis 1210 to place the first side chassis 1220 and the center chassis 1210 in a predetermined configuration when the helmet 1200 is in the open position. To this end, the first finger 1224 and the center chassis 1210 may include one or more mechanical features to enable such a mechanical engagement, which can include cooperating protrusions and indentations as shown in the figure. The mechanical features may also or instead include one or more of a friction fit, a hook, a fastener, a snap, a latch, a pin, a clamp, a clip, a gib, and so on.

Similarly, as shown in the fourth view 1204 and the fifth view 1205 of FIG. 12, one or more of the second fingers 1234 of the second side chassis 1230 may mechanically engage with the center chassis 1210 to place the second side chassis 1230 and the center chassis 1210 in a predetermined configuration when the helmet 1200 is in the open position. To this end, the second finger 1234 and the center chassis 1210 may include one or more mechanical features to enable such a mechanical engagement, which can include cooperating protrusions and indentations as shown in the figure.

The mechanical stops as described herein may also or instead be at least partially disposed on one or more connections between the center chassis 1210, the first side chassis 1220, and the second side chassis 1230, as further described below with reference to FIG. 13.

Figure 13:
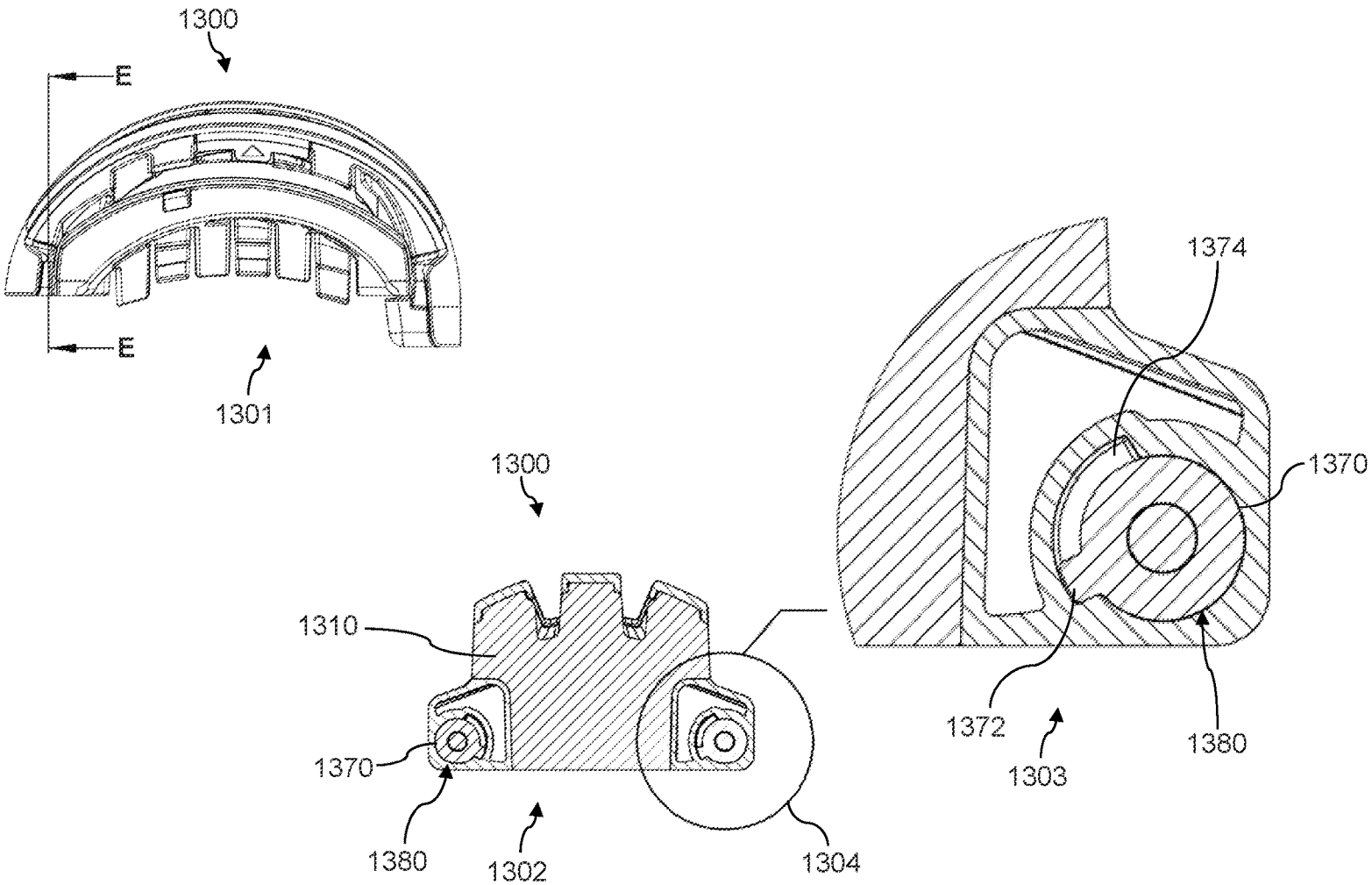
FIG. 13 shows a cross-sectional view and detail of a collapsible helmet in a closed position.

FIG. 13 shows a cross-sectional view and detail of a collapsible helmet in a closed position. Specifically, the figure shows a first view 1301 of a helmet 1300, a second view 1302 of the helmet 1300 through Section E-E of the first view 1301, and a third view 1303 showing a detailed look at the encircled area 1304 of the second view 1302. The helmet 1300 shown in the various views of FIG. 13 may be the same or similar to any of the other helmets shown and described herein. In general, this figure shows a hinge assembly formed at a connection 1380 between the center chassis 1310 and each of the side chassis. It will be understood that a helmet 1300 may include four such connections 1380 with hinge assemblies, i.e., two on each side of the center chassis 1310.

As shown in the second view 1302 and the third view 1303 of FIG. 13, a second mechanical stop 1370 may be formed on the connection 1380 (e.g., each connection) between the center chassis 1310 and the side chassis. That is, the hinge or pivot point between the center chassis 1310 and the side chassis may include one or more mechanical features to permit only a desired, predetermined rotation of the side chassis relative to the center chassis 1310. This may be accomplished through the inclusion of a protrusion 1372 or the like that extends from, or is otherwise engaged with, a hinge, a bearing, rotation mechanism, or the like, where the protrusion is disposed within a cavity 1374 that limits the rotation of the center chassis 1310 and the side chassis relative to one another. It will be understood that other mechanical features may also or instead be used for the second mechanical stop 1370 at or near the connection 1380 of the center chassis 1310 and one or more of the side chassis. Further, it will be understood that other mechanical features may also or instead be used for mechanical stops described herein (e.g., instead of, or further to, the first mechanical stop 1270 described with reference to FIG. 12 and the second mechanical stop described with reference to FIG. 13) to control or limit movement of one or more of the chassis of the various helmets described herein.

Figure 14:
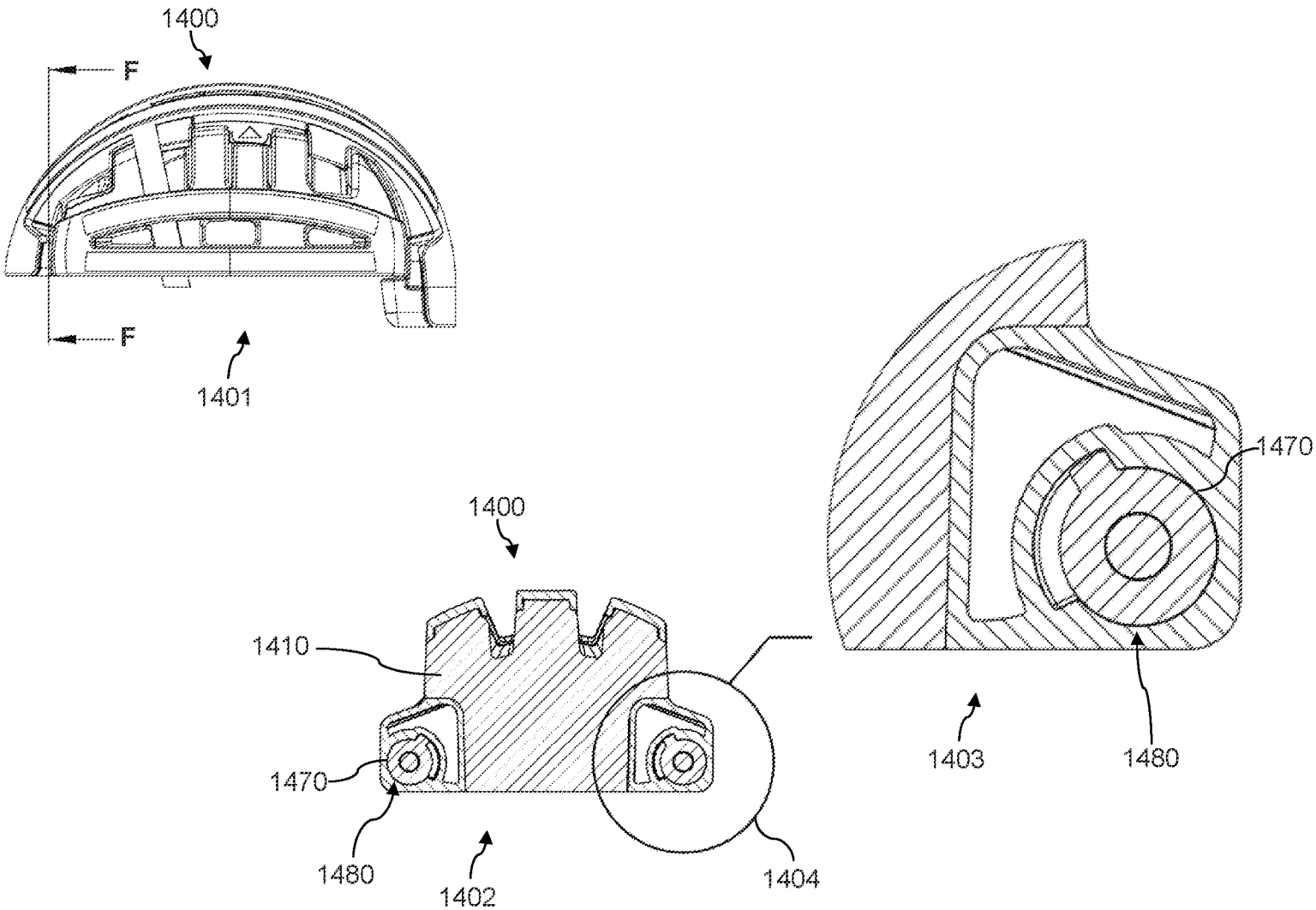
FIG. 14 shows a cross-sectional view and detail of a collapsible helmet in an open position.

FIG. 14 shows a cross-sectional view and detail of a collapsible helmet in an open position. Specifically, the figure shows a first view 1401 of a helmet 1400, a second view 1402 of the helmet 1400 through Section F-F of the first view 1401, and a third view 1403 showing a detailed look at the encircled area 1404 of the second view 1402. The helmet 1400 shown in the various views of FIG. 14 may be the same or similar to any of the other helmets shown and described herein. More specifically, the helmet 1400 shown in the various views of FIG. 14 may be the same as the helmet 1300 shown in FIG. 13, but instead of being in the closed position, the helmet 1400 in FIG. 14 is in the open position.

Similar to FIG. 13, the second mechanical stop 1470 is shown in the second view 1402 and the third view 1403 of FIG. 14, where the second mechanical stop 1470 is formed on a connection 1480 (e.g., each connection) between the center chassis 1410 and the side chassis.

Figure 15:
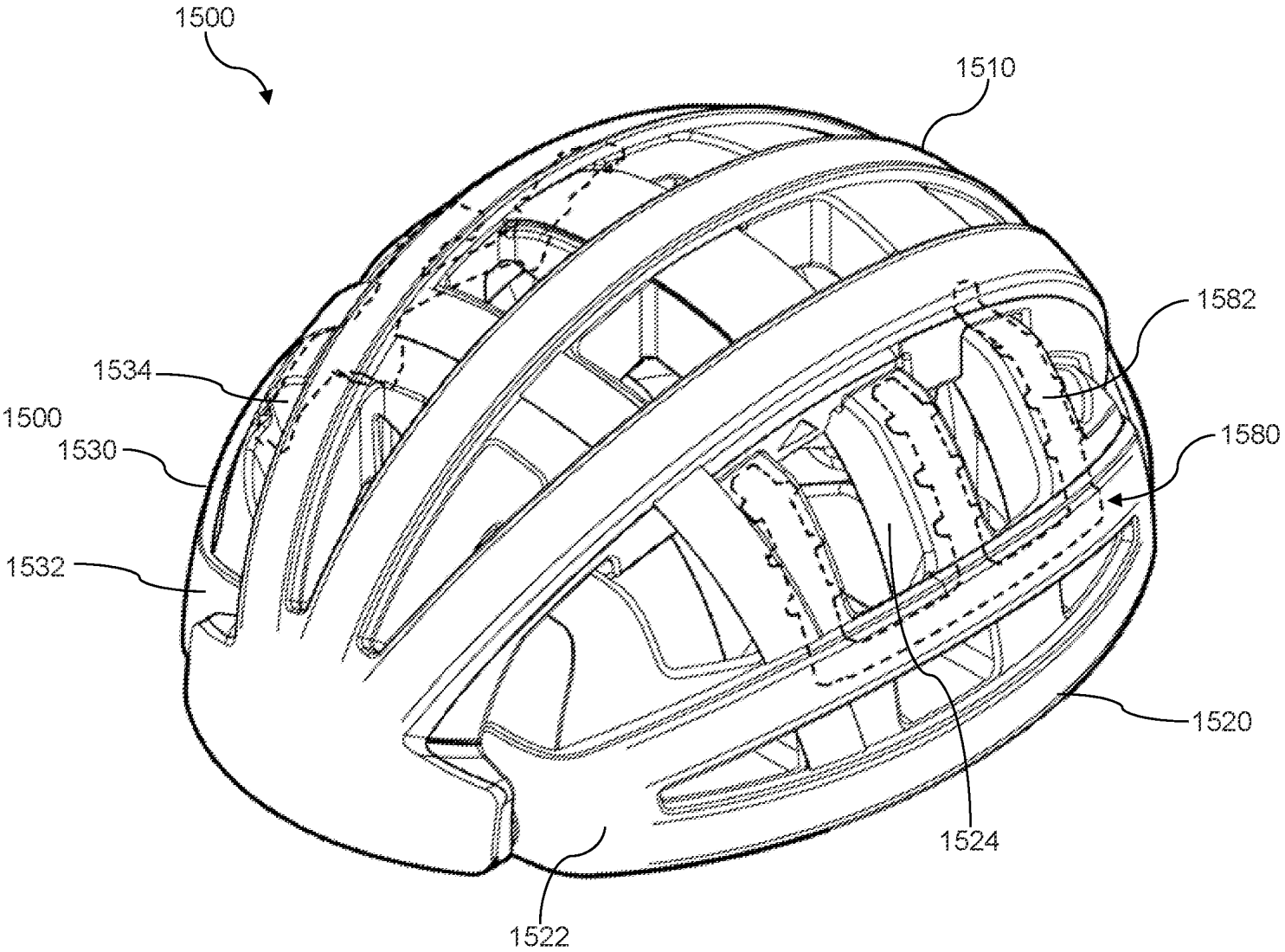
FIG. 15 shows a collapsible helmet in an open position.

FIG. 15 shows a collapsible helmet in an open position. The helmet 1500 may be the same or similar to any of the other helmets shown and described herein. For example, the helmet 1500 may include a center chassis 1510, a first side chassis 1520 having a first support 1522 and a plurality of first fingers 1524, and a second side chassis 1530 having a second support 1532 and a plurality of second fingers 1534.

As shown in the figure, the helmet 1500 may further include an internal protection system 1580 disposed in or on one or more of the chassis. The internal protection system 1580 may include one or more internal reinforcement members 1582 disposed within one or more of the center chassis 1510, the first side chassis 1520, and the second side chassis 1530. For example, as shown in the figure, an internal reinforcement member 1582 may be disposed within one or more of the plurality of first fingers 1524 and the plurality of second fingers 1534. An internal reinforcement member 1582 may also or instead be disposed within one or more of the first support 1522, the second support 1532, or the structure that forms the center chassis 1510 (or a portion thereof). The internal protection system 1580 and/or the internal reinforcement members 1582 may be made of a relatively strong material, such as ABS plastic, metal, or the like.

Thus, in general, as described herein, a collapsible helmet may include various chassis segments that are mechanically coupled to one another—e.g., a center chassis defining a void for receiving a first side chassis and a second side chassis. At least two of the chassis segments may be rotatable relative to one or more of other chassis segments between an open position and a closed position—e.g., the first side chassis may be rotatably coupled to the center chassis at one or more first connections disposed along a first pivot axis and the second side chassis may be rotatably coupled to the center chassis at one or more second connections disposed along a second pivot axis. The chassis segments, in the open position, may collectively define a substantially hemispheric shape sized and shaped to receive a human head. Additionally, in the closed position, at least two of the chassis segments may substantially fit within a void defined by the one or more other chassis segments. For example, a majority of the first side chassis and a majority of the second side chassis may be movable into the void of the center chassis by rotating the first side chassis about the first pivot axis and rotating the second side chassis about the second pivot axis. Each of the movable chassis segments may include a plurality of fingers that interlock when in the closed position. Further, a locking mechanism may include a locking end engaged with the movable chassis segments, where the locking end is movable to permit rotation of these chassis segments. Also, or instead, a mechanical stop may be configured to prevent rotation beyond a predetermined amount of one or more of the chassis segments relative to another chassis segment.

It will be appreciated that the devices, systems, and methods described above are set forth by way of example and not of limitation. Absent an explicit indication to the contrary, the disclosed steps may be modified, supplemented, omitted, and/or re-ordered without departing from the scope of this disclosure. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

The method steps of the implementations described herein are intended to include any suitable method of causing such method steps to be performed, consistent with the patentability of the following claims, unless a different meaning is expressly provided or otherwise clear from the context. So, for example, performing the step of X includes any suitable method for causing another party such as a remote user, a remote processing resource (e.g., a server or cloud computer) or a machine to perform the step of X. Similarly, performing steps X, Y and Z may include any method of directing or controlling any combination of such other individuals or resources to perform steps X, Y and Z to obtain the benefit of such steps. Thus, method steps of the implementations described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

It should further be appreciated that the methods above are provided by way of example. Absent an explicit indication to the contrary, the disclosed steps may be modified, supplemented, omitted, and/or re-ordered without departing from the scope of this disclosure.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context. Thus, while particular embodiments have been shown and described, it will be apparent to those skilled in the art that various changes and modifications in form and details may be made therein without departing from the spirit and scope of this disclosure and are intended to form a part of the invention as defined by the following claims, which are to be interpreted in the broadest sense allowable by law.

What is claimed is:

1. A collapsible helmet, comprising:

a center chassis having a substantially concave shape defining a void in an underside thereof;

a first side chassis including a plurality of first fingers, the first side chassis pivotably engaged with the center chassis about a first pivot axis and rotatable about the first pivot axis from a closed position to an open position; and a second side chassis including a plurality of second fingers, the second side chassis pivotably engaged with the center chassis about a second pivot axis and rotatable about the second pivot axis from the closed position to the open position, wherein, when both the first side chassis and the second side chassis are in the closed position, the plurality of first fingers and the plurality of second fingers interlock with one another within the void in the underside of the center chassis, and wherein, when both the first side chassis and the second side chassis are in the open position, the center chassis, the first side chassis, and the second side chassis together form a substantially hemispheric shape.

2. The collapsible helmet of claim 1, wherein one or more of the first side chassis and the second side chassis are lockable from movement relative to the center chassis in one or more of the open position and the closed position.

3. The collapsible helmet of claim 2, further comprising a locking mechanism including a locking end engaged with one or more fingers in the plurality of first fingers and the plurality of second fingers, the locking end movable to permit pivotal movement of one or more of the plurality of first fingers and the plurality of second fingers relative to the center chassis.

4. The collapsible helmet of claim 3, wherein the locking mechanism includes a first locking end engageable with one or more of the plurality of first fingers and a second locking end engageable with one or more of the plurality of second fingers.

5. The collapsible helmet of claim 4, wherein the locking mechanism includes a resilient member disposed across the center chassis to engage with both the plurality of first fingers and the plurality of second fingers.

6. The collapsible helmet of claim 1, wherein, when in the closed position, a majority of the plurality of first fingers and a majority of the plurality of second fingers are disposed in the void in the underside of the center chassis, and wherein, when in the open position, the majority of the plurality of first fingers and the majority of the plurality of second fingers are exposed from the underside of the center chassis to form the substantially hemispheric shape.

7. The collapsible helmet of claim 1, further comprising a shell engaged with one or more of the center chassis, the first side chassis, and the second side chassis.

8. The collapsible helmet of claim 1, further comprising an internal protection system including an internal reinforcement member disposed within one or more of the center chassis, the first side chassis, and the second side chassis.

9. The collapsible helmet of claim 1, further comprising a mechanical stop configured to prevent movement beyond a predetermined amount of one or more of the first side chassis and the second side chassis relative to the center chassis.

10. The collapsible helmet of claim 1, wherein the first side chassis is disposed on an opposite end of the center chassis relative to the second side chassis.

11. The collapsible helmet of claim 1, wherein fingers of the plurality of first fingers and the plurality of second fingers are radially offset relative to one another to permit collapse of the first side chassis and the second side chassis into the void of the center chassis.

12. A helmet, comprising:

chassis segments mechanically coupled to one another, at least two of the chassis segments rotatable relative to one or more of other chassis segments between an open position and a closed position, the chassis segments, in the open position, collectively defining a substantially hemispheric shape sized and shaped to receive a human head, and, in the closed position, the at least two of the chassis segments substantially fitting within a void defined by the one or more other chassis segments.

13. The helmet of claim 12, wherein the chassis segments include a center chassis defining the void, a first side chassis, and a second side chassis, and wherein the first side chassis is rotatably coupled to the center chassis at one or more first connections disposed along a first pivot axis and the second side chassis is rotatably coupled to the center chassis at one or more second connections disposed along a second pivot axis.

14. The helmet of claim 13, wherein a majority of the first side chassis and a majority of the second side chassis are movable into the void of the center chassis by rotating the first side chassis about the first pivot axis and rotating the second side chassis about the second pivot axis.

15. The helmet of claim 12, wherein each of the at least two of the chassis segments includes a plurality of fingers that interlock when in the closed position.

16. The helmet of claim 12, further comprising a locking mechanism including a locking end engaged with one or more of the at least two of the chassis segments, the locking end movable to permit rotation of one or more of the at least two of the chassis segments.

17. The helmet of claim 12, further comprising a shell engaged with one or more of the chassis segments.

18. The helmet of claim 12, further comprising an internal protection system including an internal reinforcement member disposed within one or more of the chassis segments.

19. The helmet of claim 12, further comprising a mechanical stop configured to prevent rotation beyond a predetermined amount of one or more of the at least two of the chassis segments relative to the one or more other chassis segments.

* * * * *